US005271106A

United States Patent [19]

McClish et al.

[11] Patent Number: 5,271,106

[45] Date of Patent: Dec. 21, 1993

[54] EMULATIVE SWIMMING POOL

[76] Inventors: Richard E. D. McClish, 1739 Addison #15, Berkeley, Calif. 94703; John H. Hollis, 765-15th St., Oakland, Calif. 94612

[21] Appl. No.: 957,418

[22] Filed: Oct. 6, 1992

[51] Int. Cl.[5] ..... E04H 4/00

[52] U.S. Cl. ..... 4/494; 4/507; 352/89; 434/254

[58] Field of Search ..... 4/488, 494, 496, 904, 4/507; 434/254; 352/47, 48, 89

[56] References Cited

U.S. PATENT DOCUMENTS

| | | | |
|---|---|---|---|
| 1,731,554 | 10/1929 | Wheeler | 4/488 |
| 2,035,835 | 3/1936 | Raber | 4/488 |
| 2,875,528 | 3/1959 | Garate | 4/488 X |
| 3,655,272 | 4/1972 | Valadez | 352/48 X |
| 3,945,132 | 3/1976 | Parmelee | 352/89 X |
| 4,805,631 | 2/1989 | Roi du Maroc, II | 434/254 X |
| 5,054,134 | 10/1991 | Teratsuji et al. | 4/488 |
| 5,061,061 | 10/1991 | Robley et al. | 352/47 X |

FOREIGN PATENT DOCUMENTS

| | | | |
|---|---|---|---|
| 3529467 | 3/1986 | Fed. Rep. of Germany | 4/488 |

*Primary Examiner*—Robert M. Fetsuga

[57] ABSTRACT

A swimming pool producing surrounding visual effects utilizes large picture generating surfaces adjacent to water-containing surfaces for displaying large images emulative of remote swimming environments. The pool has controllable water currents for in-place swimming or diving in one or more directions. These controlled water currents and the large images are coordinated by a computer for producing a virtual underwater environment in which picture scenes evolve and water-currents flow as a function of swimmer activity. A large apparent swimming area can therefore be produced. For added realism, the pool may include sound-generating devices and parametric weather machines to accurately emulate natural environments and also produce spectacular special effects for the swimming or diving subject and for possible observers thereof.

5 Claims, 2 Drawing Sheets

EMULATIVE SWIMMING POOL

TECHNICAL FIELD

The present invention relates to swimming pools and more specifically to underwater systems for simulating various swimming and diving environments.

BACKGROUND ART

Swimming pools for recreational and sporting activities are well known in the art. Conventional swimming pools are typically permanent combination pools having a shallow end and a deep end, and they often include equipment for competitive sporting activities. The underwater surfaces of such pools often exhibit depth and/or swimming lane indications.

Underwater television systems capable of monitoring and recording the aquatic performance of swimming subjects are known in the art. Such devices are typically used by security personnel and sports instructors for remotely viewing swimmers in action.

When used for recreational and social activities, conventional swimming pools offer little more than the midly illuminated body of water they contain and are therefore usually but a component of an exercise facility. U.S. Pat. No. 4,650,179 issued to Bond shows a health spa fitted with one such pool.

Swimming flumes are known in the art for the purpose of training olympic athletes and the like. U.S. Pat. Nos. 4,845,787 issued to Lior and 5,005,228 issued to Mermelstein describe swim-in-place systems having controllable water currents. These are typically provided with pumps that produce a continuous water flow, so someone swimming against the current can regulate his or her swimming activity in order to swim substantially in place, allowing the swimmer in action to be accurately observed and videotaped while training. It is known to have such flumes fitted with dry and wet observation ports allowing multiple views of the swimming subject.

Although extremely useful for technical research purposes, these flumes have not yet been adapted for enhancing the enjoyment of aquatic activities in recreational, social and artistic contexts.

OBJECTS OF THE INVENTION

Accordingly, it is a broad object of the present invention to provide a swimming environment producing entertaining visual effects.

It is a more specific object of the present invention to provide a swimming pool having picture-generating surfaces for producing a virtual environment perceptible by one or more swimming subjects.

It is a further object of the present invention to provide an interactive underwater picture-generating system for producing optical illusions which may be influenced by action of one or more swimming subjects.

It is a still further object of the present invention to provide the above-mentioned advantages for use in conjunction with devices capable of controlling water currents and temperatures, in a manner to emulate naturual swimming environments.

SUMMARY OF THE INVENTION

According to the invention, a swimming pool has at least one water-containing surface holding a body of water in which at least one swimmer or diver can evolve. The pool has a picture-generating surface adjacent to the water-containing surface. It is preferable that the picture-generating surface not substantially reduce the swimming area of the pool. For this purpose, the picture-generating surface may also be used as the water-containing surface.

Each picture-generating surface produces a large visible image which may be a synthesized image or a reproduction of one or more remotely observed or recorded images or a combination thereof. Prior to its reproduction on a picture-generating surface, the large visible image may exist as a video signal which may be processed in ways known in the film, television and computer graphics arts. Interactive computer video games such as flight simulators can be easily modified to emulate underwater journeys which may include interaction between the swimming subject and elements of the viewed picture scene.

It is thus possible to produce entertaining underwater scenes and optical illusions to enhance the enjoyment of aquatic activities. Such optical illusions may include the emulation of natural swimming and diving environments. It is also possible to produce special effects for training professional swimmers and divers, and for teaching emergency measures or special maneuvers in a controlled environment. Pools of the present invention can thus emulate past, present and future historic, touristic and working environments, and add interactive decor to artistic, athletic, competitive, social and recreational water activities.

In order to produce a substantially realistic environment simulation, it is desirable to have a water current flowing in the body of water in a manner that a swimmer or diver can swim or dive substantially in place against the current while the picture scene displayed by the picture-generating surfaces changes at a controlled rate to simulate an ambulatory rate of the swimmer or diver in the emulated environment. In order to keep the subject swimming or diving in place, water-current producing means such as electric water-pumps with the associated ducts and piping may be servo-controlled using a logic data processor monitoring motional information of the swimming or diving subject. This motional information may be obtained using a camera or other suitable sensor array for determining the swimmer's activity, position and orientation, in a manner to produce signals for generating the proper water currents so the subject swimming or diving in the pool is maintained substantially in place. This also enables the subject to change direction in the pool and always face the current. In this manner, a relatively small body of water can emulate an oceanic environment, allowing the swimmer or diver to explore apparently large sites during a virtual journey.

It may also be desirable to have a temperature-controlled water current for emulating the different water temperatures occurring in the virtual swimming path. A ceiling image may also be produced to simulate an apparent space over the body of water. Changes in this ceiling image may be coordinated with corresponding changes in an underwater picture scene. Parametric weather machines may also be included to still further emulate natural environmental phenomena such as rain, winds, a waterfall, sea waves, etc.

DETAILED DESCRIPTION OF THE PREFERRED EMBODIMENTS

Figure 1:
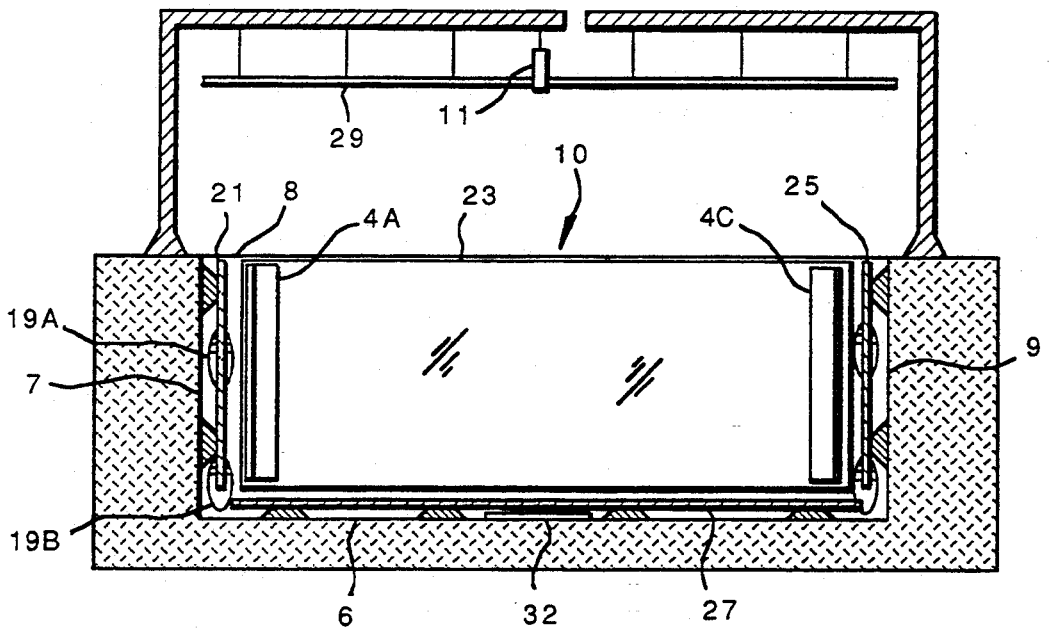
FIG. 1 is a side section view of a swimming pool according to the present invention.
Figure 2:
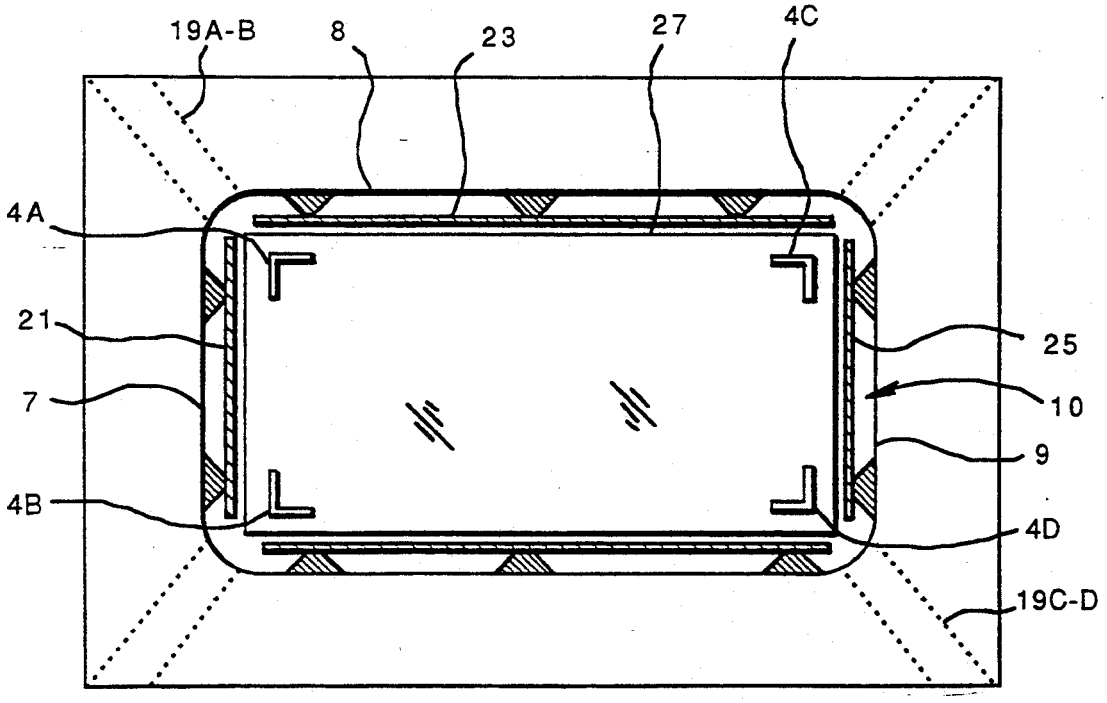
FIG. 2 is a plan view of the swimming pool of FIG. 1.

Referring now to FIGS. 1 and 2 of the drawings, a swimming pool according to the present invention comprises a basin 10 having water-containing surfaces such as walls 7, 8 and 9 and a bottom 6 for containing a body of water. The pool has picture-generating display panels 21, 23, 25, 27 adjacent to the walls 7, 8 and 9 and to the bottom 6 of the basin 10 for displaying large images to be viewed by a swimming subject evolving in the water contained in the basin 10.

Each picture-generating panel 21, 23, 25 or 27 may be a liquid crystal display, a light-emitting diode array, a flat television screen or other suitable apparatus for producing a large visible image onto or near a submerged surface of the basin 10.

A submerged loudspeaker 32 is used to produce sounds in the basin 10. The loudspeaker 32 may be of the conventional type, or it may be a contact transducer for vibrating one or more picture-generating panels 21, 23, 25 or 27 in the basin 10. Audio data for producing the sounds to be produced in the basin 10 may be stored in the form of recorded waveforms or they may be synthesized from program algorithms in ways known to the electronic music, and sound recording arts.

The basin 10 has water ducts 19A–19D connected to a controllable water pump 16 and to a controllable metering system 18 through appropriate plumbing circuitry. The ducts 19A–19D may be located in the corners of the basin 10, as illustrated, or they can be located wherever it is practical, in view of the nature of the picture-generating devices in use in the pool. For example, perforated display panels would enable different duct sizes and locations than those illustrated to be used successfully in the present invention. The ducts 19A–19D are used to produce servo-controlled water currents which can be made to flow in different directions through the basin 10. In order to avoid producing jet-like currents in the basin 10, water-current diffusers 4A–4D are used in front of the ducts 19A–19D. The diffusers 4A–4D may be transparent for minimum interference with the images produced on the picture-generating panels 21, 23, 25 and 27. The means of fixation of the diffusers 4A–4D to the basin 10 have been omitted for clarity.

A television camera 11 aimed generally at the basin 10 produces a video signal indicative of the orientation and of the swimming motions of a swimming subject evolving in the basin 10.

A overhead picture-generating panel 29 is used to produce ceiling images over the basin 10. These overhead images are preferably complementary to those of the submerged display panels 21, 23, 25 and 27 in order to produce a more realistic optical illusion for the swimming subject, and for possible obervers thereof. In order for the camera 11 to have a head-on view of the swimmer, there may be an aperture in the overhead display panel 29 through which the objective of the camera 11 may protude.

Figure 3:
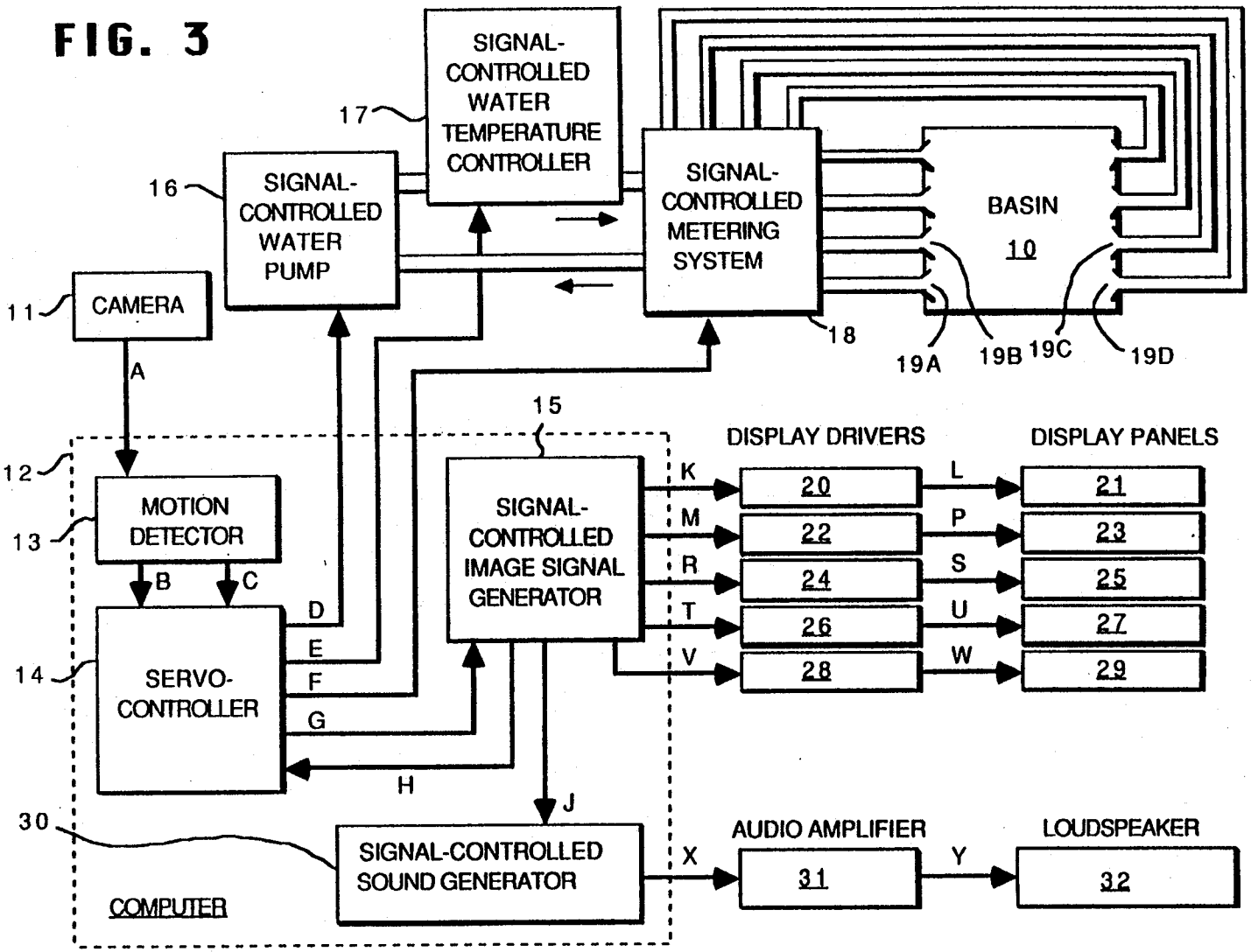
FIG. 3 is a block diagram of the computer-controlled systems used in the swimming pool of FIGS. 1 and 2.

Referring now to FIG. 3, a logic block diagram shows the interactive relationship between the sensing, the displaying and the controlling elements of the present invention which appear in FIGS. 1 and 2.

An electronic computer 12, comprising a motion detector 13, a servo-controller 14, a signal-controlled image-signal generator 15 and a signal-controlled audio-signal generator 30, processes the data received in signal A from the television camera 11 in order to determine the position, the orientation and/or the swimming movements of a swimmer evolving in the water.

In response to the video data from the television camera 11, the motion detector 13 produces servo-control signals B and C which contain amplitude and direction information indicative of the position of the swimmer in the water. The servo-controller 14 compares the data from the motion detector 13 with reference data indicative of a preferred position of the swimmer in the water. The servo-controller 14 then produces signal D and F which respectively activate the signal-controlled water pump 16 and the signal-controlled water metering system 18 in a manner to maintain the swimmer at the preferred location determined by the reference data in the servo-controller 14. The water metering system 18 is typically composed of an array of signal-controlled valves selectively actuated by the servo-controller 13. Such valves are well known in the art and require no further description. The servo-controller 14 also produces a temperature-control signal E which is applied to the water temperature controller 17 in response to water temperature data in signal H produced in association with the appropriate picture scenes by the image-signal generator 15. The water metering system 18 is hydraulically connected to water ducts in the basin 10, allowing, for example, first selected ducts 19A, 19B to emit water into the basin 10 while other selected ducts 19C, 19D cooperate to extract an equivalent amount of water from the basin 10, thus producing a controllable water current, while the water level in the basin 10 remains substantially constant. In this manner, the water currents are automatically regulated, the swimmer evolves freely and does not have to adjust his or her swimming activity to the water-currents in order to be maintained at a pre-determined location in the basin 10.

In addition to producing the servo signals D, E and F which automatically maintain the swimmer in a temperature-controlled water current at a pre-determined location in the basin 10, the servo-controller 14 also produces an scroll-control signal G for influencing image signals K, M, R, T and V produced by the image signal generator 14. The image signals K, M, R and T are fed to display drivers 20,22,24 and 26 which produce the required signals L, P. S and U activating the picture-generating display panels 21,23,25 and 27 in order to produce a large visible image in the basin 10. The image signal V is fed to display driver 28 which drives display panel 29 suspended above the basin 10. The image-signal generator 15 also produces a control signal J for triggering a signal-controlled audio-signal generator 30 which produces audio signal X. Control signals for triggering the audio-signal generator 28 are preferably coordinated with the occurrence of certain images in the image signal generator 15 in a manner to produce a coherent audio-visual environment in the basin 10. The signal X is amplified by audio amplifier 31 for driving the submerged loudspeaker 32 located in the basin 10. Using appropriate stored programs, the computer 12 can change the images and the sounds perceived by the swimmer in a manner to produce audio-visual illusions.

One such illusion is the simulation of a moving outdoor picture scene. When the swimmer is swimming substantially in place in the basin 10 while a picture scene is changing in a manner consistent with the direction and amplitude of the water currents in the basin 10, the swimmer experiences a sensation of motion within what appears to be a swimming path which can be perceived by the swimmer as vastly exceeding the actual size of the basin 10. It is also possible to change the apparent swimming speed of the swimmer by variably amplifying or attenuating the scroll control signal G. In order to facilitate egress of the swimmer from the pool, the computer 12 may have a software program for recognizing an externally applied signal such as modulated light or a sound originating at the general location of the swimmer. This way, the swimmer can be assisted in leaving the basin 10 by pre-determined water currents, upon transmitting the appropriate signal to the computer 12. For this purpose, a small flashlight pointed at the camera 11 may be used by the swimmer as a signal-generation device. A beep from a sound source, or the sound produced by a voice or a hand clap could also be used in conjunction with the appropriate sound detection devices for producing an 'exit' signal for the servo-controller 14. More sophisticated devices could be used too.

A timer could be used in conjunction with the servo-controller 14 and the image generator 15, in order to time-limit the journey and/or determine the total apparent length of the virtual swimming path. The timer could also be used to monitor time elapsed in a minimum water-current mode, which would enable a swimmer to be assisted in leaving the basin 10 after a certain period of relative immobility.

Still other variations of the present invention will suggest themselves to persons skilled in the art. For example, sonar or differential thermal-sensing detectors may be used instead of a camera to sense swimming activity in the pool. Screens and projectors may be used instead of flat picture-generating panels. More than one computer may be used and the picture scenes can emulate a virtually unlimited number of environments, from outer-space to subatomic. It is intended therefore that the foregoing description be considered as exemplary only, and that the scope of the invention be ascertained by the following claims.

What is claimed is:

1. An emulative swimming pool comprising:

a basin for holding a body of water, at least one water-contacting surface associated with said basin and submerged in said body of water, image-generating means responsive to a control signal for producing a visible image on said water-contacting surface in said body of water, water-current generating means responsive to a control signal for producing a controlled water current in said body of water, and means responsive to changes in position of a subject swimming in said body of water for producing control signals for controlling said water-current generating means and for correspondingly altering said visible image in a manner to simulate a displacement of said subject in a virtual swimming environment perceived by said subject as being larger than said body of water.

2. The swimming pool of claim 1 further comprising means for controlling said water current in a manner to facilitate egress from a pre-determined swimming area of said swimming pool.

3. The swimming pool of claim 1 further comprising water-temperature controlling means for controlling the temperature of said controlled water current.

4. The swimming pool of claim 1 further comprising means to produce a large visible image above said body of water, whereby changes in said large visible image above said body of water are coordinated with corresponding changes in said large visible image in said body of water.

5. The swimming pool of claim 1 further comprising sound-generating means for producing sounds in said body of water, whereby said sounds in said body of water are coordinated with changes in said large visible image in said body of water.

* * * * *